United States Patent [19]

Nakayama

[11] Patent Number: 4,759,457

[45] Date of Patent: Jul. 26, 1988

[54] TAMPER EVIDENT AND TAMPER-PROOF PACKAGE

[76] Inventor: Raymond M. Nakayama, 120 Opihikao Way, Honolulu, Hi. 96825

[21] Appl. No.: 41,185

[22] Filed: Apr. 22, 1987

[51] Int. Cl.[4] ..... B65D 53/00

[52] U.S. Cl. ..... 215/270; 215/228; 220/4 E

[58] Field of Search ..... 215/270, 262, 297, 228; 220/4 B, 4 E

[56] References Cited

U.S. PATENT DOCUMENTS

| | | | |
|---|---|---|---|
| 1,325,056 | 12/1919 | Taliaferro | 215/270 |
| 2,024,532 | 12/1935 | Maneuso et al. | 215/262 |
| 2,280,070 | 4/1942 | Glocker | 215/262 |
| 3,672,527 | 6/1972 | Bly | 215/270 |
| 3,850,330 | 11/1970 | Koontz et al. | 215/262 |
| 4,111,326 | 9/1978 | Percarpio | 215/270 |

FOREIGN PATENT DOCUMENTS

| | | | |
|---|---|---|---|
| 1171574 | 1/1959 | France | 215/297 |

*Primary Examiner*—Stephen Marcus
*Assistant Examiner*—Nova Stucker
*Attorney, Agent, or Firm*—Thomas S. MacDonald; Alan H. MacPherson; Paul J. Winters

[57] ABSTRACT

A tamper-proof, tamper-edvident package includes a pill, capsule, ingestible or medicant bottle-holding container and a sealing lig thereover. The lid includes a flexible lip with a conical sealing surface surrounding the container and in angular juxtaposition upon assembly with a more rigid conical sealing surface on the container. A vacuum is drawn in a fixture holding the container and lid by evacuation of air. Upon subsequent exposure of the container/lid exteriors to ambient environmental air the flexible lip is snapped tight by differential pressure (higher on the exterior of the package) so that the lip sealing surface which was at an angle to the container seal surface, is in parallelism with the container seal surface resulting in a wide sealing band which is not breakable by normal hand pulling or twisting. If the interior vacuum is broken by prying the seal apart or by inserting a hypodermic needle to adulterate the contents, the user when purchasing the package can easily ascertain tampering due to the ease with which the container and lid parts can be taken apart.

15 Claims, 2 Drawing Sheets

TAMPER EVIDENT AND TAMPER-PROOF PACKAGE

FIELD OF THE INVENTION

This invention relates to containers for protection of products ingestible by humans where the user can easily determine if the package has been tampered with in any way and providing for child-resistant use protection after legitimate opening of the package. More particularly, the invention is directed to a package which, if tampered with previous to sale to the customer, will be readily apparent to the user by observation or tactile feel.

BACKGROUND OF THE INVENTION

Considerable interest has been generated by instances of tampering involving placement of dangerous foreign substances, particularly in drug or other pharmaceutical packages While there have been various improvements made to more assure the consuming public of the safety and efficacy of the packaged product, it is still difficult for a customer to determine if the package has been tampered with, particularly if the tampering was by injection of a substance by a fine hypodermic needle. In such event, the normal package material has sufficient elasticity or rheological properties to allow the resultant aperture to effectively close after removal of the needle, at least sufficient to be unobservable unless very careful inspection is made. Such would necessitate time-consuming viewing over the entire surface of the package to ascertain any small puncture mark. As a practical matter, the public cannot be taught to perform such inspection without imposition of fear and an adverse feeling against the product and its manufacturer. The overall problem has been exacerbated by poison contamination of capsules causing deaths to users and wide spread recalls of various products.

In an attempt to solve these problems, special seals have been developed for the caps sealing pharmaceutical bottles. Inflated packages, as exemplified by U.S. Pat. No. 4,449,631, have been suggested, which when ruptured would lose the inflation and a printed pattern thereon, which after deflation would be distorted and apparent to the consumer by casual inspection. The same patent discusses another attempted solution of employing color-changing pH sensitive sensors in the package which display a different color under atmospheric pressure than at a higher pressure. Such a system would be relatively expensive. U.S. Pat. No. 4,546,881 provides a heat-sealed elastomeric material vacuum-formed over the container to its elastic limit which will rupture and split upon being punctured. U.S. Pat. No. 4,436,203 includes an inner pressurized enclosure and an outer enclosure, one or both being of bellows-like configuration, the outer enclosure being closed after its internal pressure is reduced. If the outer package is pierced the package bellows sections expand or pop out giving a visual indication of tampering. While this arrangement appears operable the use of two enclosures would be costly in material and manufacturing cost and expensive in assembly over the product to be protected.

U.S. Pat. No. 2,137,745 shows a tape packaging container comprising a pair of nesting elements with a melted-in-place sealing gasket providing an hermetic seal therebetween when air is removed from the interior of the container. External pressure tends to hold the nesting elements together. A coin is used to pry the elements apart to break the gasket seal and admit air to the interior allowing overall opening of the container. In U.S. Pat. No. 4,449,632, pressured gas fills a space between two container and elastic layers tightly stretched thereover. The device deflates upon tamper-puncturing and such condition is observable. U.S. Pat. No. 4,150,744 discloses an impermeable foil envelope which is purged of air to form a vacuum around an oxygensensitive inner medication dispenser bottle. U.S. Pat. No. 4,522,666 discloses the sealing and bonding of sealed telescoping capsule parts involving a vacuum and melting of the gelatin of the capsule to form a seal. Separate ring seals have been suggested, as seen in U.S. Pat. No. 4,573,582, which fracture or distort when a closure is removed thus indicating tampering.

SUMMARY OF THE INVENTION

According to the invention one simple two-part construction is employed to effectively seal a container for capsules, pills, other pharmaceutical forms, or other ingestible drug or food-stuffs. A first part comprises a normally cylindrical open-mouthed container of rigid or semi-rigid material and having an annular outwardly-facing conical seal surface adjacent and around the open mouth. A second part comprises a tamper-proof lid of flexible or semi-flexible plastic material having a depending lip with an inwardly-facing depending annular conical seal surface, which has a cone angle smaller than the cone angle of the seal surface of the open-mouthed container. After the desired contents of the container have been placed therein, the lid part is placed over the container part so that an exterior bottom edge of the lid lip conical seal surface contacts a lower portion of the container seal surface in essentially a line contact. Upon air evacuation from the interior of the interior of the container-lid combination atmospheric pressure surrounding the exterior of the lid lip forces the flexible lip sealing surface downwardly so that it is parallel to and at the same cone angle as the container conical seal surface, thus providing a wide annular conical sealing band between the lid lip and container. When the two annular sealing surfaces are in conformance an effective seal results completely around the container and lid preventing any hand twisting or pulling of the lid off the container. The lid includes at its top a break-seal area of reduced thickness which a legitimate user can pierce with a pin, nail or other puncturing instrument to allow air to enter into the lid and container interior. The flexible lip of the lid is then no longer pressed downwardly by the absence of a differential higher atmospheric pressure, and thus returns to its unflexed position with a smaller cone angle, breaking the great majority of the annular sealing band and allowing the lid to be easily lifted or twisted off the container.

If there has been any tampering either by prying off the lid or any intrusion of the container/lid vacuum interior by a hypodermic needle or the like, this would also release the vacuum and balance the exterior and interior pressures. If the consumer is able to remove the lid from the container without piercing the break-seal area he or she then knows the package has been tampered with. Likewise, storekeepers can check each package periodically to see if tampering has occurred, particularly after a first tampering incident has been reported. Such should minimize the recall of all packages when only a few have been tampered with.

The invention contemplates the use of a relatively simple apparatus for making the initial conical seal, including a two-part sealed form or fixture with an internal cavity for receiving the two-part container to be sealed, a vacuum source, a lid positioning spring, an apparatus vacuum shut-off valve, and atmospheric pressure inlet valve. After air evacuation from the cavity and the two-part container, the vacuum valve is shut and the entire cavity and contents are at below atmospheric pressure. The positioning spring applies pressure to locate the lid in proper register. When an atmosphere inlet valve is opened, air is introduced into the cavity, forcing the lid against the container and firmly seating the broad seal across areas of each into contact.

The lid may be further provided with a rib or slot at an end opposite the lip which is insertable in a corresponding slot or rib in the container for reclosing (not vacuum resealing) the lid on the container to prevent small children from easily opening the unsealed lid and container during its use in the home.

Various embodiments are also disclosed including a throw-away outer container for drug bottles where the conical surface of the container may be inwardly or outwardly facing and a food container in which opposed flexible halves have annular flanges with at least one conical sealing surface.

DETAILED DESCRIPTION

Figure 1:
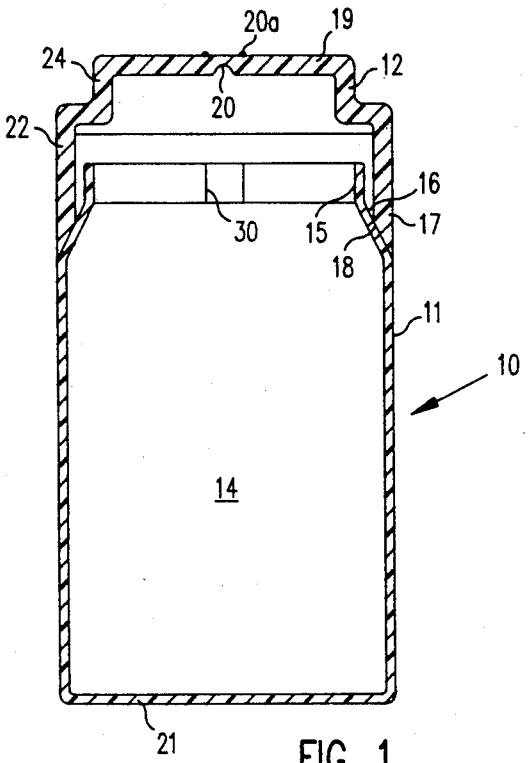
FIG. 1 is a cross-sectional side view of a lid and container embodiment in sealed condition.
Figure 2:
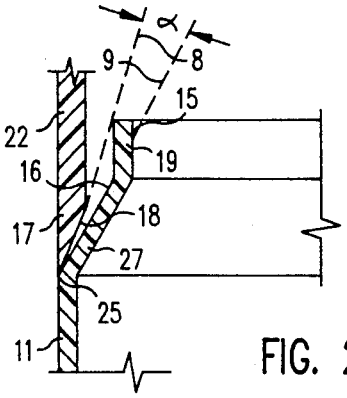
FIG. 2 is a partial cross-sectional view of the lid and container upon initial assembly but prior to sealing.

The invention shown in FIG. 1 comprises a two-part package 10 having a container part 11 with an inwardly flared, outwardly-facing seal surface 16 and open top 15. A lid 12 has a depending lip 17, with an inwardly-facing second sealing surface 18. Lid 12 is lightly pressed on container 11 so that the sealing surfaces 16, 18 contact each other in a relatively loose line contact 25 (FIG. 2). The internal volume 14 of the package 10 protects the package contents, be they drug capsules, pills, a medicant bottle or other human ingestibles such as food products, when air is evacuated to form a low pressure vacuum in that volume. When that inner vacuum is maintained and the exterior of the package is exposed to ambient environmental air, nominally at 14 psia (sea level), the higher pressure of the ambient air, i.e. the differential pressure on the lid 12, forces the flexible lip 17 of a sidewall 22 downward toward surface 16 such that lip sealing surface 18 comes into contact and flexes to transform line contact 25 into contact parallelism with container seal surface 16 along the entire width of surface 18. The container 11 and lid 12 thus become relatively immovable with respect to one another so that normal human hand pressure, either by a pulling or twisting motion, will not unseat the contacting surfaces 16 and 18.

Any tampering with the casing 10 will release the vacuum in volume 14, resulting in lip 17 snapping back to its unflexed position, and the two casing parts, container 11 and lid 12, will be so loose, i.e. back in line contact only, that they will actually separate upon handling or will easily separate by a slight pull or slight twisting action or other relative movement of the casing parts. If the seal is intact, then the casing parts will be relatively immovable with respect to each other until the actual using buyer pierces or breaks the seal or casing with a thumb tack, nail or other piercing or pry tool. A slot 26 may be provided on the lip 17 or a thinned, circular area 20, appropriately outlined by circular ridge 20*a*, provided on the top 19 of the lid 12 to facilitate legitimate opening of the seal by prying or piercing, respectively.

Figure 3:
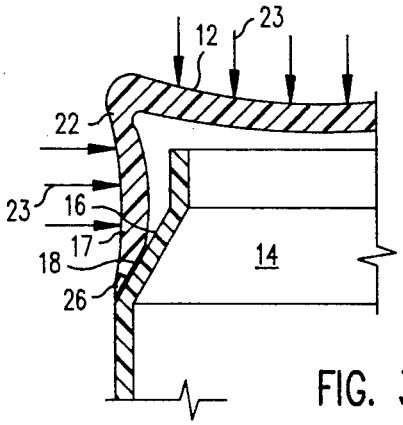
FIG. 3 is a partial cross-sectional view of the construction after internal air evacuation causing sealing.

FIGS. 2 and 3 illustrate the flexible lip sealing of the surfaces 18 and 16. The surface 18 on the lip 17 is a conical inwardly-facing peripheral fairly-wide band extending along a taper of the lid open end. The width of the band in one embodiment is about 50 mm. The band surface 18 extends in a cone angle, in the non-flexed condition of the sidewall 22 of the lid 12, at an angle $\alpha$ from the conical cone angle of the container sidewall seal surface 16, which normally is wider in width than lip sealing surface 18. The angle $\alpha$ may be from about 10° to about 30° dependent on the flexibility of the lid sidewall 22, the thickness of the sidewall and the needed differential pressure across the lip and the conical section 27 on which the seal surface 16 is formed. In FIG. 3, arrows 23 illustrate the effect of the higher ambient environmental air on lip 17 forcing surface 18 against surface 16 due to the differential pressure between it and the vacuum of the package interior.

Figure 4:
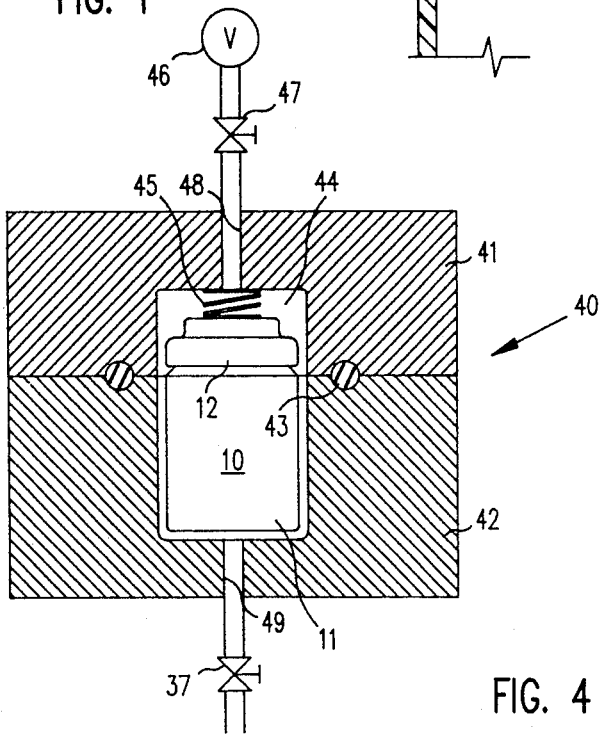
FIG. 4 is a schematic cross-sectional side view of an apparatus useful for evacuation and sealing of the lid and container.

FIG. 4 shows a schematic drawing of an apparatus suitable for evacuating and sealing each package in seriatim The sealing of the package is done by placing the package 10 into a cavity 44 in a two-part fixture 40. A container part 11 containing the ingestible is placed in fixture part 42 and the lid 12 mounted thereon. A second fixture part 41 with O-ring seal 43 completes the interior cavity 44 to be evacuated. A lid positioning spring 45 at the top of the cavity 44 keeps parts 12 and 11 in alignment. An aperture 48 is provided in fixture part 41 extending to cavity 44 from a vacuum source 46 and a vacuum drawn through aperture 48 and open valve 47 to evacuate air to a value of from about 2–13 psia in the cavity 44. The vacuum inlet valve 47 is then closed and atmospheric pressure admitted through aperture 49 in bottom fixture 42 by opening valve 37. Atmospheric pressure will then act on the outside of lid 12 (arrows 23—FIG. 3) forcing sealing surface 18 into parallelism (FIG. 3) with seal surface 16 resulting in a wide band of sealing area therebetween. The fixture halves are then opened and the sealed package 10 and its contents removed therefrom. Atmospheric pressure continues to force lip 17 against the container rigid sidewall tapered section 27 due to the lower vacuum pressure remaining in region 14 and the inward acting differential pressure.

In the embodiments shown in FIGS. 1–3, 5 and 6 the tamper-proof lid is preferably made of a semi-flexible transparent or translucent plastic such as flexible polyvinyl chloride, and which has sufficient flexibility in an about 20 mm cross-sectional wall thickness to move the lip sealing surface into wide band contact with the container seal surface. The tamper-proof container is preferably made of transparent or translucent rigid or semi-rigid plastic such as polyethylene.

Figure 5:
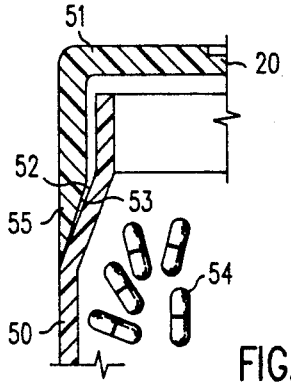
FIG. 5 is a cross-sectional partial side view of a lid and container for capsules.

FIG. 5 illustrates an embodiment in which container 50 having a conical seal section 52 is filled with an ingestible such as capsules 54. Lid 51 having a depending lip 55 is placed over the open top of container 50 such that upon air evacuation from the container interior and subsequent exposure of the package exterior to ambient environmental pressure the lip 55 is flexed downwardly so that sealing surface 53 over its entire area contacts seal surface 52.

Figure 6:
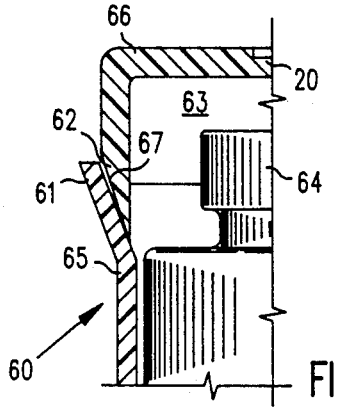
FIG. 6 is a cross-sectional partial side view of a throw-away lid and container embodiment for a medication dispensing bottle.

FIG. 6 illustrates a throw-away embodiment in which a package 60 includes a container 65 of semi-rigid plastic material including a flexible lip 61 for holding a discrete medicant or other pill bottle 64. A lid 66 made of a more flexible plastic material than container 65 includes a lip 62 with a conical sealing surface 67 at a cone angle less than the cone angle of lip 61. Upon drawing a vacuum within volume or region 63, using the apparatus of FIG. 4 for example, and then exposing the exterior of the package to ambient air, lid 66 will be pushed downwardly by the differential pressure between the exterior air and the interior vacuum, effecting a mating seal between the facing surfaces of lips 61 and 62. Any tampering with the package 60 will admit air to the region 63 which will snap-out the flange or lip 61 so that the lid 66 can be easily removed from container 65.

Figure 7:
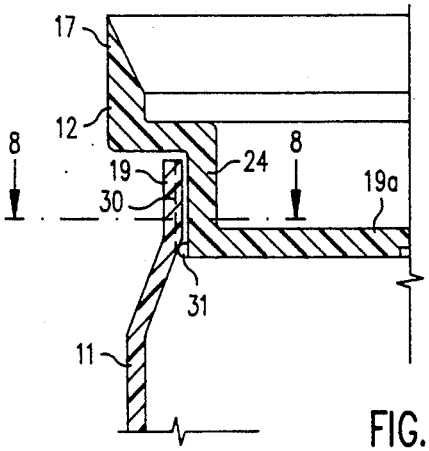
FIG. 7 is a cross-sectional partial side view of a lid and container embodiment having a post opening substantially child-resistant reclosing feature.
Figure 8:
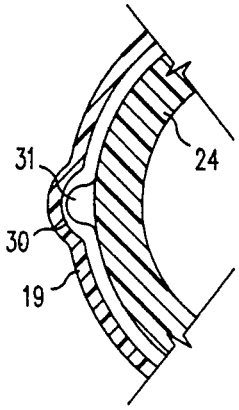
FIG. 8 is a cross-section partial plan view of the embodiment of FIG. 7 taken on the line 8—8.
Figure 9:
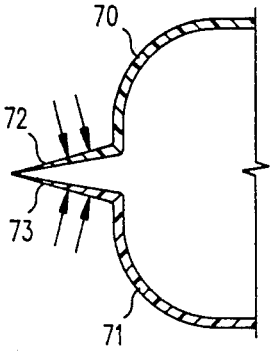
FIG. 9 is a cross-sectional partial side view of a food package constructed in accord with the invention.

FIG. 7 illustrates a substantially child-resistant feature contained at an opposite end of the lid from the lip 17. An interior slot 30 parallel to the package longitudinal (vertical) axis is provided in container side wall portion 19 and a nib or protrusion 31 provided on the outer peripheral edge of lid top 19*a*. After the initial tamper-proof seal has been removed by the purchaser, the lid may be inverted for reusable closing with the container 11 by inserting the nib 31 in the slot 30 preferably in a friction-fit. For added protection, as is known in the art, provision may be made to include a more positive locking of the inverted cap on the open end of container 11. Further, the package may contain or be distributed with simple written instructions (1) indicating to the purchaser that if the lid and container are separable by hand that the product should be brought to the attention of the seller or returned and (2) that the purchaser should pierce the thinned lid area to provide lid removal.

Figure 10:
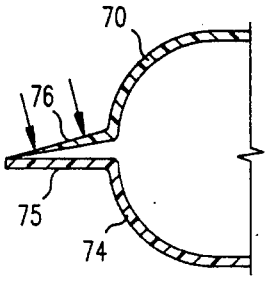
FIG. 10 is a cross-sectional partial side view of an additional embodiment of a package in accord with the invention.
Figure 11:
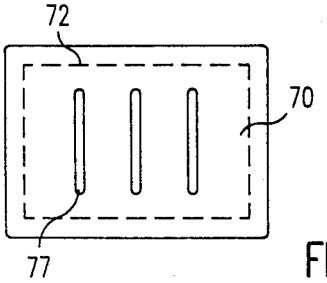
FIG. 11 is a top plan view of a complete package of FIG. 9.
Figure 12:
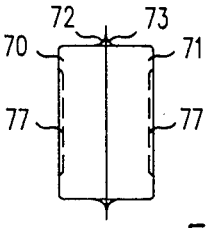
FIG. 12 is a side view of the complete package of FIG. 9.

FIGS. 9–12 illustrate a rectangular relatively-flat container/lid construction particularly useful with food containers, such as meat packages. Upon assembly with the food material therein in an apparatus of the type shown in FIG. 4, a container half 71 and lid half 70 are air evacuated and then upon exposure to the higher pressure of ambient air flexible sealing flanges 72 and 73 are snapped tight (FIG. 9) or one flexible flange 76 snapped tight on a more rigid flange 75 (FIG. 10). In this embodiment, as in the others, one of the container and lid parts must be of more flexible material than the other although both must be of sufficient stiffness, i.e. it is not a thin film, so that it does not collapse internally upon air evacuation of its interior.

In an embodiment where the casing must span a relatively large distance, e.g. to encapsulate a flat steak or other large food stuff, the casing parts may be in the form of similar halves with lateral or egg-crate ribs 75 integrally formed therewith to give structural stiffness to the casing halves so that handling will not accidentally break the seal.

A surface smoothing material 16*a*, 18*a* (FIG. 2) such as Teflon-spray may be applied to the seal and sealing surfaces of the container and lid of the various embodiments to give a smooth surface finish sufficient to keep intact the differential pressure seal between the sealing surfaces, e.g. 16, 18, under normal handling and before purposeful opening by the legitimate user.

The above description of embodiments of this invention is intended to be illustrative and not limiting. Other embodiments of this invention will be obvious to those skilled in the art in view of the above disclosure.

I claim:

1. A tamper-proof package comprising:

a first container for a human ingestible material;

a second container surrounding and sealing said first container, said second container having a sidewall and an open top forming an internal volume holding said first container, said sidewall including a sidewall first seal surface adjacent said open top;

a sealing lid for closing said second container open top, said sealing lid including a lip having a tapered end sealing surface which tapered end sealing surface, upon assembly on said second container open top, faces said first seal surface and extends at an angle from about 10° to about 30° with respect to said first seal surface; and wherein said second container sidewall and said sealing lid are constructed of materials having a different degree of rigidity and flexibility such that when said internal volume is air evacuated, a differential pressure between ambient environmental air and a resultant internal vacuum extends across said second container and said lid lip, forcing said tapered end sealing surface inwardly toward said first seal surface and into parallelism with said first seal surface to retain said vacuum and prevent hand removal of said lid from said second container.

2. The package of claim 1 wherein said first seal surface is an outwardly-facing conical surface adjacent the open top of said second container and said lip and said tapered end sealing surface is flexed by ambient environmental air into parallelism with said first seal surface.

3. The package of claim 1 in which said second container is constructed of relatively-rigid material and said lid is constructed of relatively semi-flexible material.

4. The package of claim 1 in which said sidwall first seal surface and said tapered end sealing surface are conical surfaces, and said tapered end sealing surface surrounds the sidewall first seal surface at a steeper cone angle than the cone angle of said first seal surface, said lip being flexible such that said lip is flexed by said differential pressure to bring said first seal surface and said tapered end sealing surface into a broad band of sealing surface area.

5. A tamper-proof package comprising:

a container having a sidewall and open top forming a first internal material-holding volume, said sidewall including a sidewall first seal surface adjacent said open top;

a sealing lid encompassing and closing said open top, said sealing lid including a flexible lip having a second tapered end sealing surface which tapered end sealing surface upon assembly on said container faces said sidewall first seal surface and extends at an angle from about 10° to about 30° with respect to said sidwall first seal surface; and wherein when said material-holding volume is vacuum evacuated of air, air pressure of ambient environmental air acts on the exterior of said flexible lip forcing said lip second tapered end sealing surface toward and into sealing parallelism with said sidewall first seal surface as long as a differential pressure exists between the pressure acting on the exterior of said container and lid and a vacuum is retained in said internal first material-holding volume.

6. The package of claim 5 wherein said sidewall first seal surface is an inwardly facing tapered conical surface adjacent the open top of the container and said lip second sealing surface is an outwardly facing conical surface adjacent an open end of said lid.

7. The package of claim 6 in which said lid has sufficient flexibility and cross-sectional dimension to allow a differential pressure of from about 2 psia to 13 psia to bring said lid second sealing surface into parallelism with said container first seal surface to effect a seal between said surfaces and prevent hand removal of said lid from said container.

8. The package of claim 5 wherein said lid includes an area of reduced thickness which is pierceable to relieve the vacuum in said container internal volume and allow separation of said first real surface and second seal surface to open the package.

9. The package of claim 5 wherein said seal surface and said sealing surfaces have a surface finish sufficient to effectively seal and prevent hand removal of said container and lid at a differential pressure across said lip of from about 2 to 13 psia.

10. The package of claim 9 in which said first and second surfaces include a smoothing layer applied thereto to form matching sealing surfaces.

11. The package of claim 5 further including an entry matching guideway slot and rib in said container and said lid extending parallel to the axis of said container and extending along a position displaced from said container first seal surface and said lid second sealing surface for temporary reuniting said container and lid in closing but non-sealing condition.

12. The package of claim 11 in which said lid contains a first open tapreed lip forming said sealing surface and a second integral closed cylindrical portion in said displaced position containing one of said slot or said rib and wherein said lid is invertible to temporarily reunite said container and said lid.

13. The package of claim 5 in which said sidewall first seal surface is an outwardly tapered outwardly-facing conical surface adjacent the open top of said container and said lip second sealing surface.

14. A tamper-proof package comprising:

a container having a sidewall and open top forming a first internal material-holding volume, said sidewall including a sidwall first seal surface adjacent said open top;

a sealing lid encompassing and closing said open top, said sealing lid including a flexible lip having a second sealing surface which upon assembly on said container faces said sidwall first seal surface and extends at an angle to said sidwall first seal surface;

wherein when said material-holding volume is vacuum evacuated of air, air pressure of ambient enviornomental air acts on the exterior of said flexible lip forcing said lip second sealing surface into sealing parallelism with said sidwall first seal surface as long as a differential pressure exists between the pressure acting on the exterior of said container and lid and a vacuum is retained in said internal first material-holding volume; and in which said container and said lid are shaped in complementary matching halves and said first seal surface and second sealing surfaces extend on a flange extending peripherally around each of said container and lid.

15. The package of claim 14 further including integral ribs on said matching halves for reinforcing said halves.

* * * * *